US007502485B2

(12) United States Patent
Mouri et al.

(10) Patent No.: US 7,502,485 B2
(45) Date of Patent: Mar. 10, 2009

(54) LOUDSPEAKER, LOUDSPEAKER MODULE, AND ELECTRONIC EQUIPMENT USING THE LOUDSPEAKER MODULE

(75) Inventors: Tetsuya Mouri, Mie (JP); Satoshi Itoh, Mie (JP); Masahide Sumiyama, Mie (JP)

(73) Assignee: Panasonic Corporation, Osaka (JP)

( * ) Notice: Subject to any disclaimer, the term of this patent is extended or adjusted under 35 U.S.C. 154(b) by 741 days.

(21) Appl. No.: 10/533,771

(22) PCT Filed: Oct. 14, 2004

(86) PCT No.: PCT/JP2004/015573

§ 371 (c)(1),
(2), (4) Date: May 4, 2005

(87) PCT Pub. No.: WO2005/039235

PCT Pub. Date: Apr. 28, 2005

(65) Prior Publication Data

US 2006/0239478 A1 Oct. 26, 2006

(30) Foreign Application Priority Data

Oct. 16, 2003 (JP) ..... 2003-356080
Oct. 21, 2003 (JP) ..... 2003-360216
Oct. 22, 2003 (JP) ..... 2003-361694

(51) Int. Cl.
*H04R 1/02* (2006.01)
*H04R 1/00* (2006.01)
*H04R 1/20* (2006.01)
*H04R 25/00* (2006.01)

(52) U.S. Cl. ..... 381/388; 381/186; 381/342; 381/423; 381/432

(58) Field of Classification Search ..... 381/89, 381/151, 186, 342, 388, 431, 432
See application file for complete search history.

(56) References Cited

U.S. PATENT DOCUMENTS 7,020,302 B2 * 3/2006 Konishi et al. ..... 381/431
7,218,743 B2 * 5/2007 Sumiyama et al. ..... 381/186

FOREIGN PATENT DOCUMENTS

JP 11-175191 7/1999
JP 11-289366 10/1999
JP 2002-223494 8/2002
JP 2003-179988 6/2003
JP 2003-230187 8/2003

* cited by examiner

*Primary Examiner*—Brian Ensey
(74) *Attorney, Agent, or Firm*—Wenderoth, Lind & Ponack, L.L.P.

(57) ABSTRACT

Provided are a low-profile loudspeaker, loudspeaker module, and electronic equipment having improved hermeticity and excellent characteristics and for use in audio equipment. The loudspeaker, loudspeaker module, and electronic equipment are structured by embedding a frame for supporting a first diaphragm in a recess, forming a fit rib for engagement with the frame in a panel for supporting a second diaphragm, or coupling the panel for supporting the second diaphragm to the second diaphragm via a combination.

49 Claims, 8 Drawing Sheets

FIG. 15 – PRIOR ART
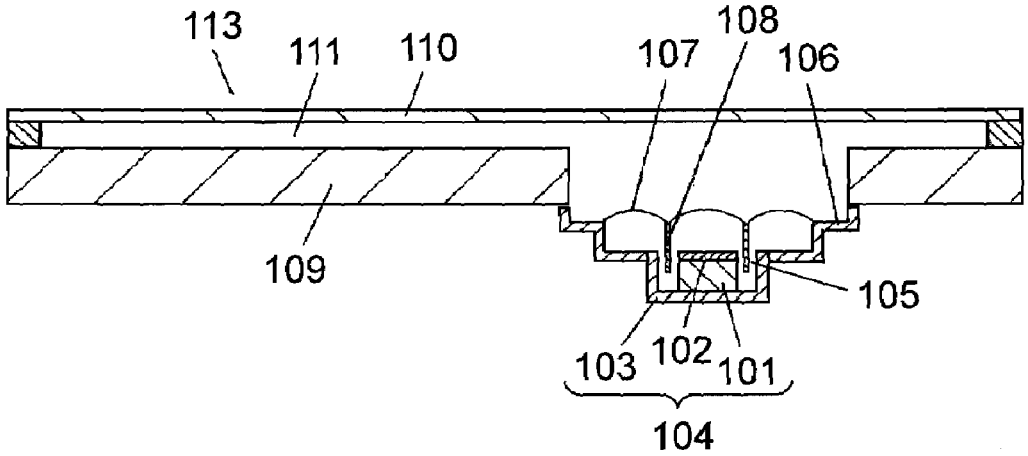

LOUDSPEAKER, LOUDSPEAKER MODULE, AND ELECTRONIC EQUIPMENT USING THE LOUDSPEAKER MODULE

This application is a U.S. national phase application of PCT International Application PCT/JP2004/015573

TECHNICAL FIELD

The present invention relates to a loudspeaker and loudspeaker module for use in various kinds of audio equipment and telecommunications equipment, and to electronic equipment using this loudspeaker module, such as a portable telephone and game machine.

BACKGROUND ART

A conventional arrangement is described with reference to FIG. 15. FIG. 15 is a sectional view of a conventional loudspeaker. As shown in FIG. 15, magnet 101 is sandwiched between top plate 102 and yoke 103 to form inner magnet type magnetic circuit 104. To yoke 103 in this magnetic circuit 104, frame 106 is connected. To the periphery of this frame 106, first diaphragm 107 is attached. To this first diaphragm 107, voice coil 108 is connected. Voice coil 108 is fitted in magnetic gap 105 in magnetic circuit 104.

Further, panel 109 is connected to the periphery of frame 106. To this panel 109, substantially planar second diaphragm 110 is attached. Hermetic space 111 acoustically couples first diaphragm 107 and second diaphragm 110 to form loudspeaker 113.

Such a conventional art is disclosed in Japanese Patent Unexamined Publication No. 2003-179988, for example.

SUMMARY OF THE INVENTION

A loudspeaker includes:

a frame coupled to a magnetic circuit;

a first diaphragm coupled to the outer periphery of the frame;

a voice coil coupled to the first diaphragm and partially fitted in a magnetic gap in the magnetic circuit;

a panel coupled to the frame;

a space surrounded by the panel having the first diaphragm coupled thereto; and a second diaphragm coupled to the space surrounded by the panel, wherein the frame is embedded in a recess formed in the panel, or the frame is coupled to the panel by forming in the panel a fit rib that has a diameter smaller than the inside diameter of a flange of the frame and larger than the outside diameter of an edge of the first diaphragm and fitting the fit rib in the frame, or the panel is coupled to the second diaphragm by a combination having at least pressure sensitive adhesive.

BRIEF DESCRIPTION OF THE DRAWINGS

FIG. 15 is a sectional view of a conventional acoustic coupling type loudspeaker.

DETAILED DESCRIPTION OF THE PREFERRED EMBODIMENTS

Now, the present invention is described with reference to first to fourth exemplary embodiments.

Reduction in the thickness of a set incorporating a loudspeaker, i.e. electronic equipment, such as a portable telephone, is strongly requested in the market. Thickness reduction of a loudspeaker is essential to reduce the thickness of such electronic equipment. However, the conventional loudspeaker is of the acoustically coupling type. Because the loudspeaker has two diaphragms, it is extremely difficult to reduce its thickness from the viewpoint of design.

The present invention addresses the above problem and aims to provide an excellent low-profile loudspeaker, loudspeaker module, and electronic equipment using the loudspeaker module.

According to one aspect of the present invention, there is provided a loudspeaker structured so that a step of a recess in a panel is at least 0.3 mm. This structure allows the step to be used as a guide when a frame is connected to the panel, thus improving productivity.

Further, in the present invention, the dimension of the recess in the panel can be minimized. The recess can be used as a high-precision guide when the frame is connected to the panel and minimize a decrease in the strength of the panel.

Alternatively, in the present invention, a large dimension to some degree is ensured for a recess in a panel to improve productivity. By providing at least three projections for guiding a frame in the panel, the projections can be used as a high-precision guide.

Additionally, the present invention can eliminate air leakage between the panel and the frame, and thus ensures hermeticity in an acoustically-coupled hermetic space and prevents vibrating noise.

Further, the present invention can improve design flexibility.

Further, in the present invention, even when a display is disposed under a second diaphragm, the display is visible through a transparent film. This can further reduce the thickness and size of a module or electronic equipment using this loudspeaker, and improve design flexibility thereof.

According to another aspect of the present invention, there is provided a loudspeaker module structured so that the second diaphragm of the loudspeaker covers a front face of the display. This structure can reduce the thickness and size of the display and loudspeaker to form an integral module.

According to a further aspect of the present invention, there is provided electronic equipment including the loudspeaker module and an operating part. This structure can reduce the thickness and size of the electronic equipment.

Exemplary embodiments of the present invention are described hereinafter with reference to the accompanying drawings.

First Exemplary Embodiment

Figure 1:
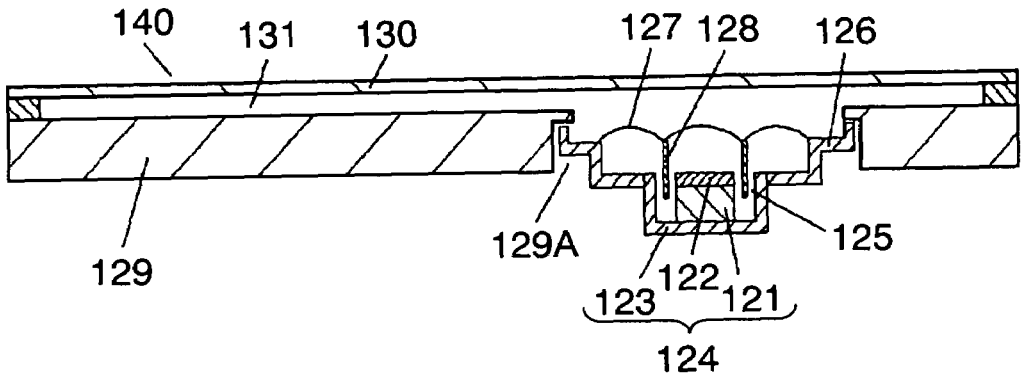
FIG. 1 is a sectional view of a loudspeaker in accordance with an exemplary embodiment of the present invention.

The first exemplary embodiment is described hereinafter. FIG. 1 is a sectional view of a loudspeaker in accordance with an exemplary embodiment of the present invention. As shown in FIG. 1, magnet 121 is sandwiched between top plate 122 and yoke 123 to form inner magnet type magnetic circuit 124. To yoke 123 in this magnetic circuit 124, frame 126 is connected. To the periphery of this frame 126, the outer periphery of first diaphragm 127 is bonded. To this first diaphragm 127, one end of voice coil 128 is connected. The other end of voice coil 128 is fitted in magnetic gap 125 in magnetic circuit 124.

Further, recess 129A is formed in panel 129. In this recess 129A, frame 126 is embedded. Coupling substantially planar second diaphragm 130 to this panel 129 via hermetic space 131 acoustically couples first diaphragm 127 and second diaphragm 130 to form loudspeaker 140.

With this structure, forming recess 129A in panel 129 and embedding frame 126 in this recess 129A can reduce the thickness of an acoustic coupling type loudspeaker having two diaphragms.

Additionally, because a sufficient thickness can be ensured for panel 129, unnecessary resonance is not caused by panel 129. Thus, excellent frequency characteristics can be obtained.

Further, this invention is structured so that a step of recess 129A in panel 129 is at least 0.3 mm. In this structure, a step of at least 0.3 mm is ensured for recess 129A in panel 129. The step can be used as a guide when frame 126 is connected to panel 129, and thus the productivity of an acoustic coupling type loudspeaker is improved.

Additionally, in the present invention, recess 129A is formed in panel 129 so as to conform to the outer peripheral shape of frame 126. This structure can minimize the dimension of recess 129A in panel 129. The recess can be used as a high-precision guide when frame 126 is connected to panel 129 and minimize a decrease in the strength of panel 129.

This invention is structured so that first diaphragm 127 is smaller than second diaphragm 130. Further, in this exemplary embodiment, first diaphragm 127 is provided within the range of second diaphragm 130 from the planar viewpoint. This structure can further reduce the size and thickness of the loudspeaker and improve design flexibility thereof even when a large second diaphragm 130 is used.

Additionally, in the present invention, second diaphragm 130 is made of sheet-like transparent film. With this structure, designing components using the space under this sheet-like transparent film allows the components under the transparent film to be seen through the film. For this reason, the components can be arranged not only horizontally but effectively using the vertical direction. This structure can further reduce the thickness and size of the loudspeaker, and improve design flexibility thereof even in the use of large second diaphragm 130.

Further, in the present invention, panel 129 is made of transparent material. With this structure, using second diaphragm 130 made of the sheet-like transparent film and designing components using the space under this transparent panel 129 allows the components under transparent panel 129 to be seen through the panel. For this reason, the components can be arranged not only horizontally but effectively using the vertical direction. This structure can further reduce the thickness and size of the loudspeaker, and improve design flexibility thereof even in the use of large second diaphragm 130 and panel 129.

Second Exemplary Embodiments

The second exemplary embodiments are described hereinafter.

Figure 2:
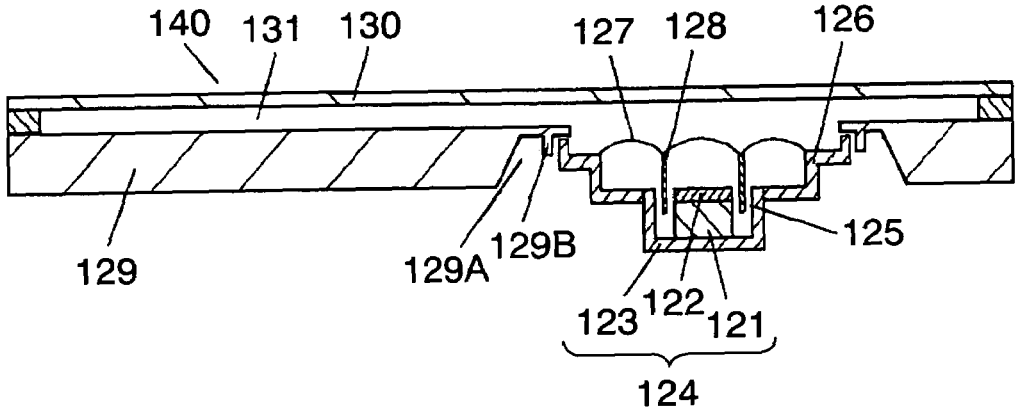
FIG. 2 is a sectional view of a loudspeaker in accordance with an exemplary embodiment.
Figure 3:
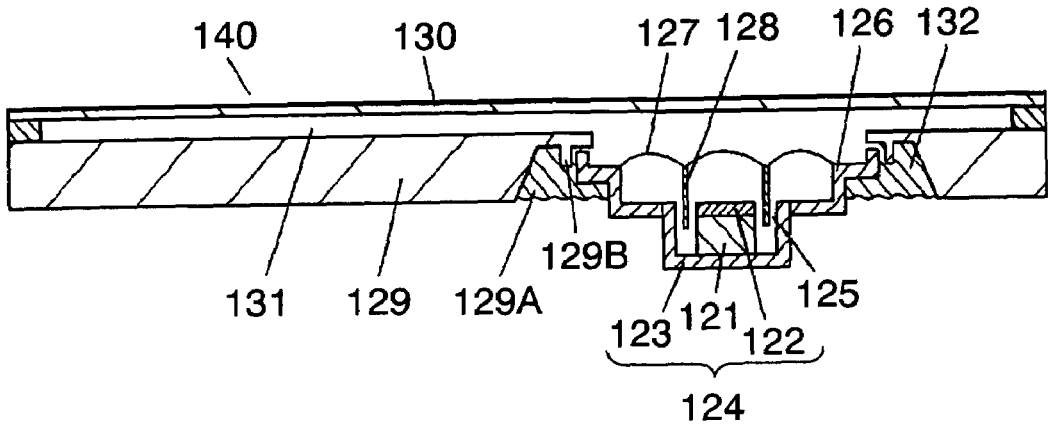
FIG. 3 is a sectional view of a loudspeaker in accordance with an exemplary embodiment.

FIGS. 2 and 3 are sectional views of loudspeakers in accordance with exemplary embodiments of the present invention. With reference to FIG. 2, what is different from the first exemplary embodiment is that recess 129A in panel 129 has at least three projections 129B for guiding a frame.

With this structure, a large dimension to some degree is ensured for recess 129A in panel 129 to improve productivity. By providing at least three projections 129B for guiding a frame in panel 129, the projections can be used as a high-precision guide.

Further, as shown in FIG. 3, the present invention is structured so that adhesive or sealing agent 132 is applied to recess 129A in panel 129. With this structure, adhesive or sealing agent 132 can eliminate air leakage between panel 129 and frame 126, and thus ensures sufficient hermeticity in acoustically-coupled hermetic space 131 and prevents vibrating noise.

As a result, the quality and reliability of acoustic coupling type loudspeaker 140 can be improved.

Third Exemplary Embodiment

The third exemplary embodiment is described hereinafter.

Figure 4:
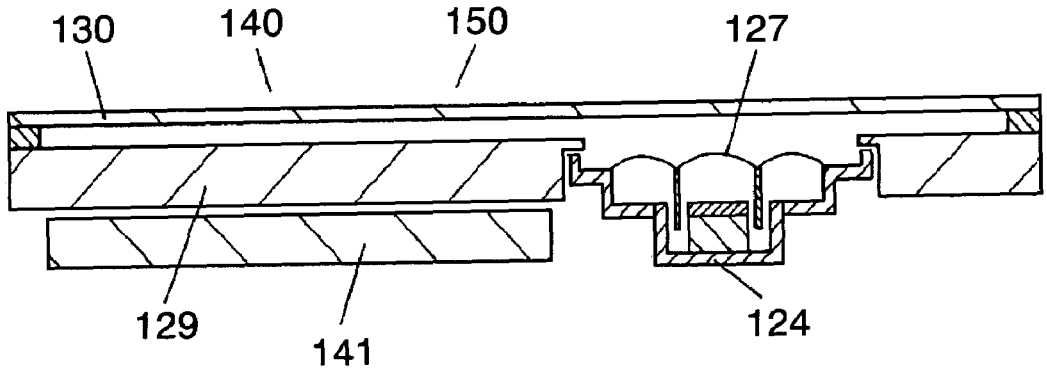
FIG. 4 is a sectional view of a loudspeaker module in accordance with an exemplary embodiment.

FIG. 4 is a sectional view of an essential part of a loudspeaker module in accordance with an exemplary embodiment of the present invention.

FIG. 4 shows a loudspeaker module structured of at least display 141 and loudspeaker 140. In this loudspeaker module 150, second diaphragm 130 of the loudspeaker is disposed in front of display 141 to cover display 141.

At this time, second diaphragm 130 is made of a transparent film sheet. Panel 129 is also made of transparent material. With this structure, providing display 141 in the space under the transparent film sheet to modularize these components allows components under the transparent film to be seen through the film. This structure can reduce the thickness of an acoustic coupling type loudspeaker module. Further, modularizing in this manner can reduce the steps in production of sets and achieve streamlining in the stage of parts distribution, thus reducing the cost.

Now, in module 150, display 141 can be disposed directly under the transparent film sheet, i.e. second diaphragm 130, or under transparent panel 129, as shown in this example.

Fourth Exemplary Embodiment

The fourth exemplary embodiment is described hereinafter.

Figure 5:
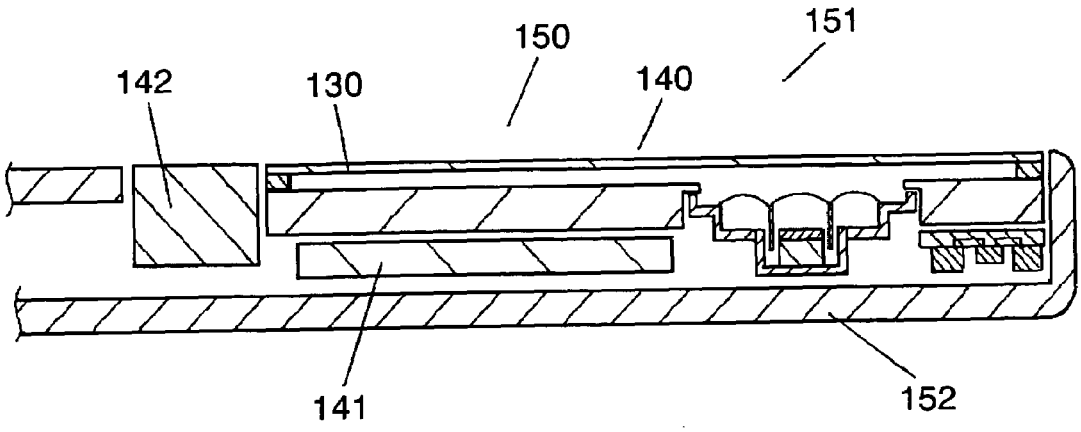
FIG. 5 is a sectional view of an essential part of electronic equipment in accordance with an exemplary embodiment.

FIG. 5 is a sectional view of an essential part of a portable telephone incorporating a loudspeaker module in accordance with an exemplary embodiment of the present invention.

FIG. 5 shows portable telephone 151 structured of loudspeaker module 150 having at least display 141 and loudspeaker 140, and operation part 142.

FIG. 5 shows portable telephone 151 structured of loudspeaker module 150 described in the third exemplary embodiment. The essential part of the portable telephone is structured by combining loudspeaker module 150 with case 152, and connecting operation part 142 beside loudspeaker module 150.

With this structure, providing display 141 in the space under this sheet-like transparent film, i.e. second diaphragm 130, and the transparent panel and providing operation part 142 beside these components can reduce the thickness and size of portable telephone 151 and improve design flexibility thereof.

In this exemplary embodiment, application in a portable telephone is described. However, the applications are not limited to this exemplary embodiment. The loudspeaker module can be used in portable audio and visual equipment, and further find wide application in electronic equipment, such as a charger for the portable audio and visual equipment.

Next, the present invention is described with reference to fifth to tenth exemplary embodiments.

The conventional loudspeaker is of the acoustic coupling type including two diaphragms and a hermetic space for coupling the diaphragms. Therefore, the acoustic characteristics of this acoustic coupling type loudspeaker can be ensured by ensuring sufficient hermeticity in the hermetic space between the two diaphragms.

However, variations in the precision of parts, and variations in production may inhibit sufficient hermeticity in a hermetic space and cause air leakage. In this case, air leakage inhibits sufficient hermeticity in a hermetic space, thus posing a problem of deteriorating acoustic coupling between two diaphragms and acoustic characteristics.

The present invention addresses this problem and aims to provide an excellent loudspeaker capable of ensuring sufficient hermeticity in its hermetic space to achieve excellent acoustic characteristics.

In the present invention, the effect of a fit rib in a complicated shape prevents air leakage, improves hermeticity, and ensures sufficient hermeticity in a hermetic space having two diaphragms. Thus, a loudspeaker having excellent acoustic characteristics can be achieved.

Alternatively, in the present invention, pressure sensitive adhesive or adhesive can fill the gap between a panel and a frame and further improve hermeticity. Further, air leakage can be eliminated and vibrating noise can be prevented.

Alternatively, in the present invention, completely filling a gap in the connection faces between a frame and a panel with sealing agent can eliminate air leakage, and prevents vibrating noise.

The present invention can further reduce the thickness and size of the loudspeaker and a module or electronic equipment using this loudspeaker, and improve design flexibility thereof.

Further, in the present invention, even when a display is disposed under a second diaphragm, the display is visible through the transparent film. This can further reduce the thickness and size of a module or electronic equipment using this loudspeaker, and improve design flexibility thereof.

Further, in the present invention, even when a display is disposed under a panel, the display is visible through a second diaphragm made of transparent film and the transparent panel. This can further reduce the thickness and size of a module or electronic equipment using this loudspeaker, and improve design flexibility thereof.

Further, electronic equipment of the present invention has the loudspeaker module and an operation part. This structure can reduce the thickness and size of the electronic equipment.

Fifth Exemplary Embodiment

The fifth exemplary embodiment is described hereinafter.

Figure 6:
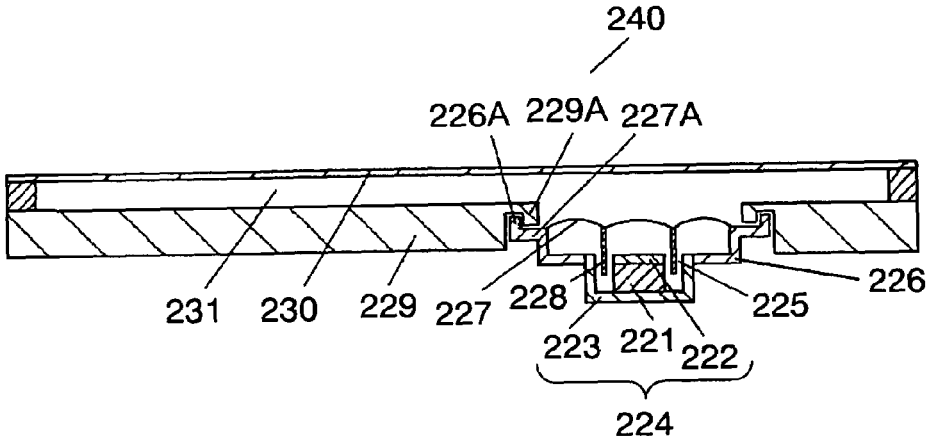
FIG. 6 is a sectional view of a loudspeaker in accordance with an exemplary embodiment.

FIG. 6 is a sectional view of a loudspeaker in accordance with an exemplary embodiment of the present invention.

As shown in FIG. 6, magnet 221 is sandwiched between top plate 222 and yoke 223 to form inner magnet type magnetic circuit 224. To yoke 223 in this magnetic circuit 224, frame 226 is connected. To the periphery of this frame 226, the outer periphery of first diaphragm 227 is bonded. To this first diaphragm 227, one end of voice coil 228 is connected. The other end of voice coil 228 is fitted in magnetic gap 225 in magnetic circuit 224.

Further, ring-shaped fit rib 229A is formed in panel 229 so as to have a diameter smaller than the inside diameter of ring-shaped flange 226A of frame 226 and larger than the outside diameter of edge 227A of first diaphragm 227. This fit rib 229A is fitted in frame 226 for engagement therewith. Then, coupling substantially planar second diaphragm 230 to this panel 229 via hermetic space 231 acoustically couples first diaphragm 227 and second diaphragm 230 to form loudspeaker 240.

With this structure, the effect of fit rib 229A in the complicated shape can prevent air leakage, improve hermeticity, and ensure sufficient hermeticity in hermetic space 231 having two diaphragms. Thus, a loudspeaker having excellent acoustic characteristics can be achieved.

Further, in comparison with the conventional art, because this embodiment has a ring-shaped recess in panel 229, the wall of panel 229 formed by this recess can be reinforced by the fit with flange 226A of frame 226. Thus, fit in the more complicated shape can be formed. This fit can prevent air leakage, and further improve hermeticity also in this recess in panel 229. This structure is useful to improve the acoustic characteristics of the loudspeaker.

This invention is structured so that first diaphragm 227 is smaller than second diaphragm 230. Further, in this exemplary embodiment, first diaphragm 227 is provided within the range of second diaphragm 230 from the planar viewpoint. This structure can further reduce the size and thickness of the loudspeaker and improve design flexibility thereof even when large second diaphragm 230 is used.

Further, in the present invention, second diaphragm 230 is made of sheet-like transparent film. With this structure, designing components using the space under the sheet-like transparent film allows the components under the transparent film to be seen through the film. For this reason, the components can be arranged not only horizontally but effectively using the vertical direction. This structure can further reduce the thickness and size of the loudspeaker, and improve design flexibility thereof even in the use of a large second diaphragm 230.

Further, in the present invention, panel 229 is made of transparent material. With this structure, using second diaphragm made of the sheet-like transparent film and designing components using the space under transparent panel 229 allows the components under transparent panel 229 to be seen therethrough. For this reason, the components can be arranged not only horizontally but effectively using the vertical direction. This structure can further reduce the thickness and size of the loudspeaker, and improve design flexibility thereof even in the use of a large second diaphragm 230 and panel 229.

Sixth Exemplary Embodiment

The sixth exemplary embodiment is described hereafter.

Figure 7:
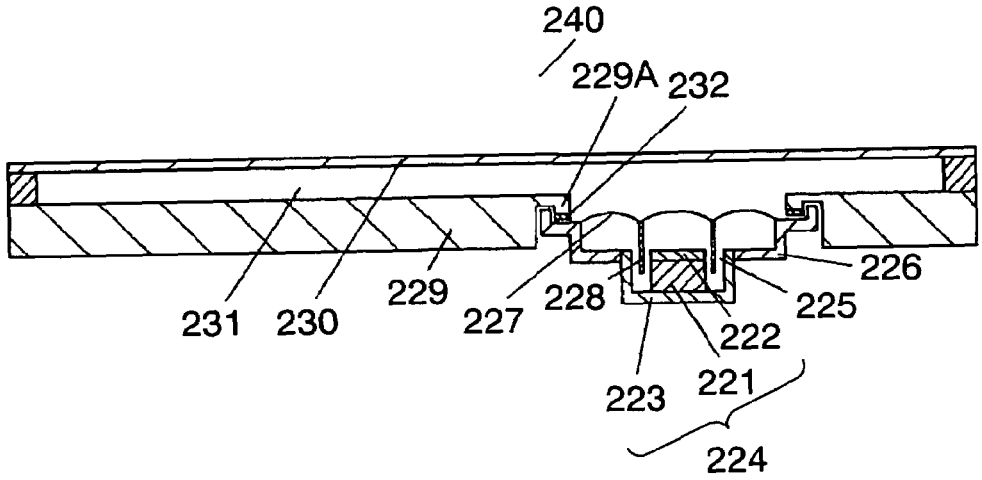
FIG. 7 is a sectional view of a loudspeaker in accordance with an exemplary embodiment.

FIG. 7 is a sectional view of a loudspeaker in accordance with an exemplary embodiment of the present invention. With reference to FIG. 7, what is different from the fifth exemplary embodiment is that pressure sensitive adhesive 232 or adhesive is applied to the connection face between fit rib 229A in panel 229 and frame 226. With this structure, pressure sensitive adhesive 232 or adhesive can fill the gap between panel 229 and frame 226 and further improve hermeticity.

Seventh Exemplary Embodiment

The seventh exemplary embodiment is described hereafter.

Figure 8:
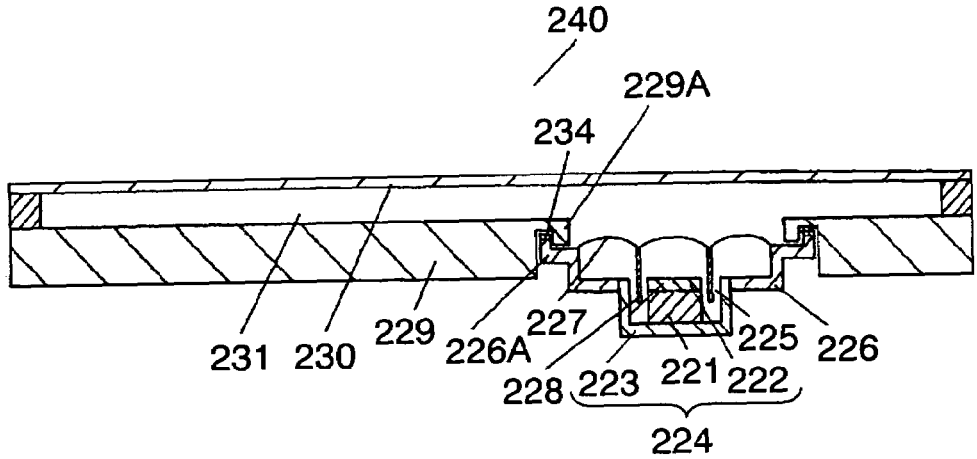
FIG. 8 is a sectional view of a loudspeaker in accordance with an exemplary embodiment.

FIG. 8 is a sectional view of a loudspeaker in accordance with an exemplary embodiment of the present invention. With reference to FIG. 8, what is different from the fifth exemplary embodiment is that pressure sensitive adhesive 234 or adhesive is applied to the connection face between frame 226 and panel 229. With this structure, pressure sensitive adhesive 234 or adhesive can fill the gap between panel 229 and frame 226 and further improve hermeticity.

Eighth Exemplary Embodiment

The eighth exemplary embodiment is described hereafter.

Figure 9:
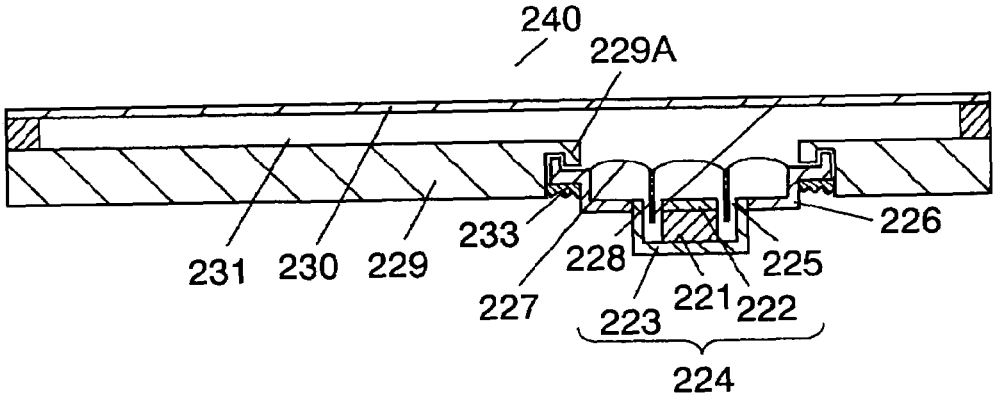
FIG. 9 is a sectional view of a loudspeaker in accordance with an exemplary embodiment.

FIG. 9 is a sectional view of a loudspeaker in accordance with an exemplary embodiment of the present invention. With reference to FIG. 9, what is different from the fifth exemplary embodiment is that adhesive or sealing agent 233 is applied to the connection face between frame 226 and panel 229. With this structure, completely filling the gap between frame 226 and panel 229 with the adhesive or sealing agent 233 can eliminate air leakage and prevent vibrating noise.

The adhesive or sealing agent 233 used in the present invention is described. Generally suitable adhesive is those based on rubber, acrylic, or polyurethane in which a large solid content remains after the adhesive is dried and cured, i.e. those of the type having a small composition ratio of diluting solvent. This type of adhesive is effective.

Generally suitable sealing agents are those based on butyl rubber or of the hot-melt type.

Ninth Exemplary Embodiment

The ninth exemplary embodiment is described hereinafter.

Figure 10:
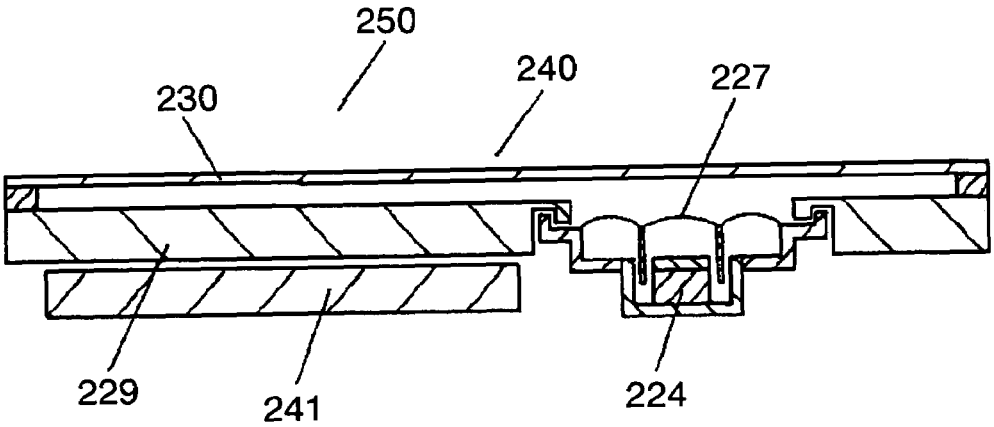
FIG. 10 is a sectional view of a loudspeaker module in accordance with an exemplary embodiment.

FIG. 10 is a sectional view of an essential part of a loudspeaker module in accordance with an exemplary embodiment of the present invention.

FIG. 10 shows a loudspeaker module structured of at least display 241 and loudspeaker 240. In this loudspeaker module 250, second diaphragm 230 of the loudspeaker is disposed in front of display 241 to cover display 241.

Second diaphragm 230 is made of a transparent film sheet. Panel 229 is also made of transparent material. With this structure, providing display 241 in the space under the transparent film sheet to modularize these components allows components under the transparent film to be seen through the film. This structure can reduce the size and thickness of an acoustic coupling type loudspeaker module and improve design flexibility thereof. Further, modularizing in this manner can reduce the steps in production of sets and achieve streamlining in the stage of parts distribution, thus reducing the cost.

Now, in module 250, display 241 can be disposed directly under the transparent film sheet, i.e. second diaphragm 230, or under transparent panel 229, as shown in this example.

Tenth Exemplary Embodiment

The tenth exemplary embodiment is described hereinafter.

Figure 11:
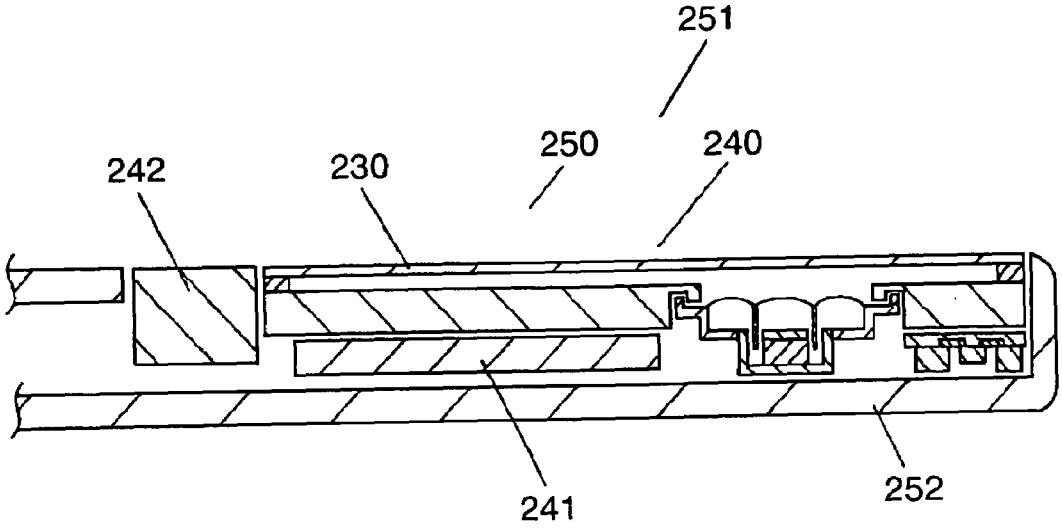
FIG. 11 is a sectional view of an essential part of electronic equipment in accordance with an exemplary embodiment.

FIG. 11 is a sectional view of an essential part of a portable telephone incorporating a loudspeaker module in accordance with an exemplary embodiment of the present invention. FIG. 11 shows portable telephone 251 structured of loudspeaker module 250 having at least display 241 and loudspeaker 240, and operation part 242.

FIG. 11 shows portable telephone 251 structured of loudspeaker module 250 described in the fifth exemplary embodiment. The essential part of the portable telephone is structured by combining loudspeaker module 250 with case 252, and connecting operation part 242 beside loudspeaker module 250. With this structure, providing display 241 in the space under this sheet-like transparent film, i.e. second diaphragm 230, and the transparent panel and providing operation part 242 beside these components can reduce the size and thickness of portable telephone 251 and improve design flexibility thereof.

In this exemplary embodiment, application in a portable telephone is described. However, the applications are not limited to this exemplary embodiment. The loudspeaker module can be used in portable audio and visual equipment, and further wide application in electronic equipment, such as a charger for the portable audio and visual equipment.

Next, the present invention is described with reference to eleventh to thirteenth exemplary embodiments.

The conventional loudspeaker is of the acoustic coupling type including two diaphragms and a hermetic space for coupling the diaphragms. Therefore, the acoustic characteristics of this acoustic coupling type loudspeaker can be ensured by ensuring sufficient hermeticity in hermetic space between the two diaphragms.

However, variations in production, such as the amount and position of applied adhesive, may inhibit sufficient hermeticity in hermetic space and cause air leakage.

Additionally, when solvent-based adhesive is used, there are variations in the ratios of the solvent and solid content in adhesive among lots. When the solid content remaining after adhesive is dried and cured is small, the gap generated by shrinkage of this adhesive causes air leakage and thus sufficient hermeticity cannot be ensured in some cases.

In these cases, air leakage inhibits sufficient hermeticity in hermetic space, thus posing a problem of deteriorating acoustic coupling between two diaphragms and acoustic characteristics. Therefore, there are problems of poor acoustic characteristics and wide variations in the characteristics of loudspeakers among production lots.

The present invention addresses the above problems and aims to provide an excellent loudspeaker capable of achieving excellent acoustic characteristics by ensuring sufficient hermeticity in its hermetic space.

In the present invention, the effect of pressure sensitive adhesive that can be produced precisely and has 100% of solid content prevents air leakage, improves hermeticity, and ensures sufficient hermeticity in a hermetic space having two diaphragms. Thus, a loudspeaker having excellent acoustic characteristics can be achieved.

Additionally, in the present invention, the clearance in a hermetic space can arbitrarily be ensured. Thus, the characteristics of an acoustic coupling type loudspeaker can be optimized and stabilized.

Further, in the present invention, the gap between a panel and a second diaphragm can be stabilized at any temperature. Thus, an acoustic coupling type loudspeaker having stable characteristics independent of ambient temperatures can be achieved.

Additionally, in the present invention, material cost and production cost can be reduced. Thus, the cost of an acoustic coupling type loudspeaker can be reduced.

Further, in the present invention, even when a display is disposed under a second diaphragm, the display is visible through transparent film. This can further reduce the thickness and size of a module or electronic equipment using this loudspeaker, and improve design flexibility thereof.

Further, in the present invention, even when a display is disposed under a panel, the display is visible through a second diaphragm made of transparent film and the transparent panel. This can further reduce the thickness and size of a module or electronic equipment using this loudspeaker, and improve design flexibility thereof.

Further, in the present invention, even when a display is disposed under a combination of a second diaphragm and a panel, the display is visible through the second diaphragm made of transparent film, transparent panel, and transparent pressure sensitive adhesive. This can further reduce the thickness and size of a module or electronic equipment using this loudspeaker, and improve design flexibility thereof.

Further, in the present invention, even when a display is disposed under a combination of a second diaphragm and a panel, the display is visible through the second diaphragm made of transparent film, transparent panel, transparent pressure sensitive adhesive, and a transparent substrate. This can further reduce the thickness and size of a module or electronic equipment using this loudspeaker, and improve design flexibility thereof.

Further, the present invention is a loudspeaker module in which the second diaphragm of the loudspeaker covers the front face of the display. This structure reduces the thickness and size of the display and loudspeaker, thus providing an integral module.

Further, electronic equipment of the present invention has the module and an operation part. This structure can reduce the thickness and size of the electronic equipment.

Eleventh Exemplary Embodiment

The eleventh exemplary embodiment is described hereinafter.

Figure 12:
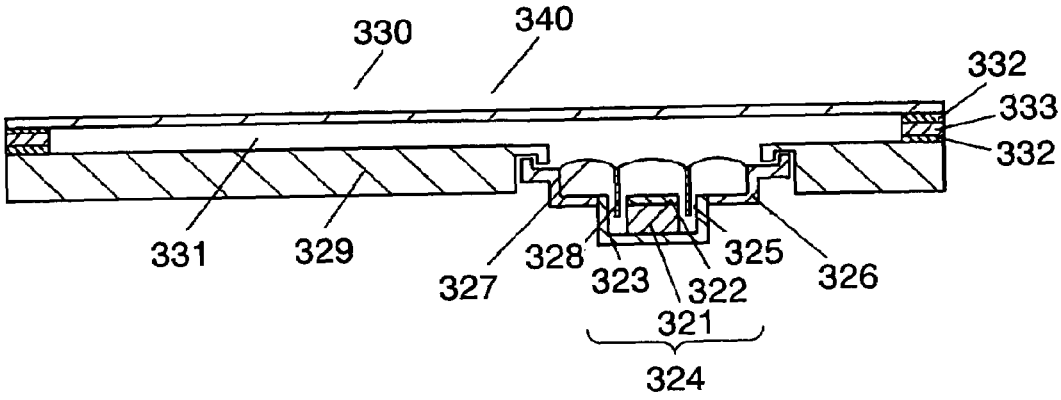
FIG. 12 is a sectional view of a loudspeaker in accordance with an exemplary embodiment.

FIG. 12 is a sectional view of a loudspeaker in accordance with the present invention. As shown in FIG. 12, magnet 321 is sandwiched between top plate 322 and yoke 323 to form inner magnet type magnetic circuit 324. To yoke 323 in this magnetic circuit 324, frame 326 is connected. To the periphery of this frame 326, the outer periphery of first diaphragm 327 is bonded. To this first diaphragm 327, one end of voice coil 328 is connected. The other end of voice coil 328 is fitted in magnetic gap 325 in magnetic circuit 324.

Further, frame 326 is connected to panel 329. Coupling substantially planar second diaphragm 330 to this panel 329 via hermetic space 331 acoustically couples first diaphragm 327 and second diaphragm 330 to form loudspeaker 340.

Now, in this loudspeaker 340, when substantially planar second diaphragm 330 is coupled to panel 329 via hermetic space 331, a combination including at least pressure sensitive adhesive 332 is used as a connecting means.

In this exemplary embodiment, the combination is of the type structured of substrate 333 and pressure sensitive adhesive 332. This substrate 333 is made of film material, such as polyethylene terephthalate (PET).

Additionally, first diaphragm 327 is smaller than second diaphragm 330. Second diaphragm 330, panel 329, pressure sensitive adhesive 332, and substrate 333 are all made of transparent material. With this structure, the effect of pressure sensitive adhesive that can be produced precisely and has 100% of solid content prevents air leakage, improves hermeticity, and ensures sufficient hermeticity in hermetic space 331 having two diaphragms. Thus, a loudspeaker having excellent acoustic characteristics can be achieved.

In other words, air leakage seen in a solvent-based adhesive can be eliminated. For a solvent-based adhesive, air leaks from the gap generated by shrinkage of solid content that is caused by solvent volatilization after the adhesive is dried and cured. Further, providing substrate 333 as well as pressure sensitive adhesive 332 and arbitrarily adjusting the thickness of this substrate 333 can ensure an arbitrary clearance in hermetic space 331, and optimize and adjust the characteristics of an acoustic coupling type loudspeaker.

Additionally, substrate 333 of the combination is made of a film material of polyethylene terephthalate (PET). This can stabilize temperature characteristics, and the film material having accurate thickness can ensure an accurate clearance in hermetic space 331. Thus, characteristics of an acoustic coupling type loudspeaker can be stabilized.

With this structure made of transparent materials, even when a display is disposed under a combination of a second diaphragm and a panel, the display is visible through the second diaphragm, panel, pressure sensitive adhesive, and substrate all made of transparent materials. This can further reduce the size and thickness of a module or electronic equipment using this loudspeaker, and improve design flexibility and sound pressure level thereof.

Further, this combination can also be made of a double-faced adhesive tape. Especially when a commercially available double-faced adhesive tape is used, material cost and production cost can be reduced, and thus the cost of an acoustic coupling type loudspeaker can be reduced.

In this exemplary embodiment, a combination made of substrate 333 and pressure sensitive adhesive 332 is described. However, the combination can be made of pressure sensitive adhesive 332 only.

Twelfth Exemplary Embodiment

The twelfth exemplary embodiment is described hereinafter.

Figure 13:
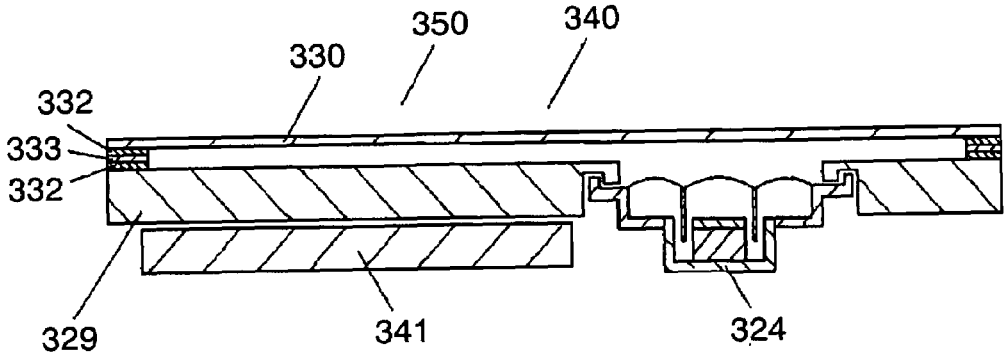
FIG. 13 is a sectional view of a loudspeaker module in accordance with an exemplary embodiment.

FIG. 13 is a sectional view of a loudspeaker module in accordance with the present invention. FIG. 13 shows a loudspeaker module structured of at least display 341 and loudspeaker 340. In this loudspeaker module 350, second diaphragm 330 is disposed in front of display 341 to cover display 341.

At this time, second diaphragm 330, panel 329, pressure sensitive adhesive 332, and substrate 333 are made of transparent materials. With this structure, providing display 341 in the space under second diaphragm 330 to modularize these components allows the display under second diaphragm 330, the pressure sensitive adhesive, and substrate to be seen therethrough.

This structure can reduce the size and thickness of an acoustic coupling type loudspeaker module and improve design flexibility thereof. Further, modularizing in this manner can reduce the steps in production of sets and achieve streamlining in the stage of parts distribution, thus reducing the cost.

Now, in this loudspeaker module 350, display 341 can be disposed directly under the transparent film sheet, i.e. second diaphragm 330, or under transparent panel 329, as shown in this example.

Thirteenth Exemplary Embodiment

The thirteenth exemplary embodiment is described hereinafter.

Figure 14:
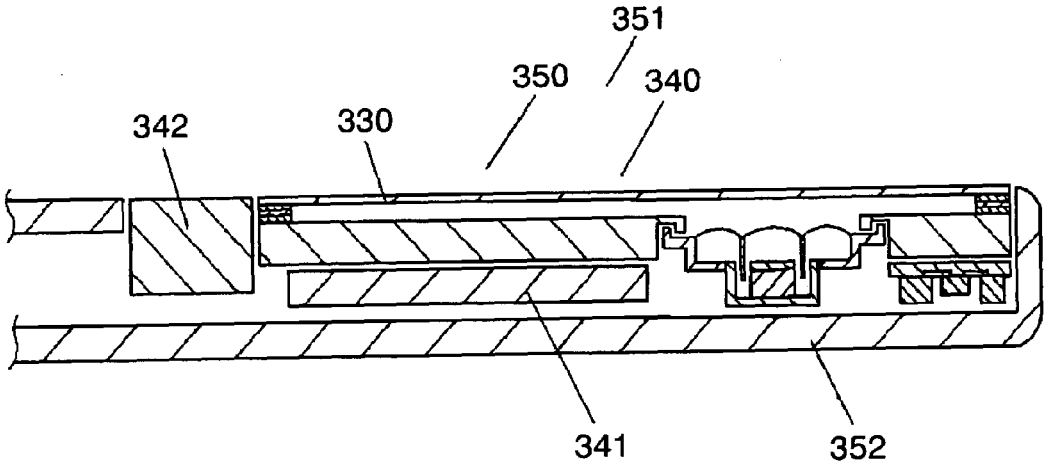
FIG. 14 is a sectional view of an essential part of electronic equipment in accordance with an exemplary embodiment.

FIG. 14 is a sectional view of an essential part of a portable telephone incorporating a loudspeaker module in accordance with an exemplary embodiment of the present invention. FIG. 14 shows portable telephone 351 structured of loudspeaker module 350 having at least display 341 and loudspeaker 340, and operation part 342.

FIG. 14 shows portable telephone 351 structured of loudspeaker module 350 described in the twelfth exemplary embodiment. The essential part of the portable telephone is structured by combining loudspeaker module 350 with case 352, and connecting operation part 342 beside loudspeaker module 350.

With this structure, similar to the twelfth embodiment, providing display 341 in the space under second diaphragm 330, the pressure sensitive adhesive, and substrate and providing operation part 342 beside these components allows the display to be seen therethrough. This can reduce the size and thickness of portable telephone 351 and improve design flexibility thereof.

In this exemplary embodiment, application in a portable telephone is described. However, the applications are not limited to this exemplary embodiment. The loudspeaker module can be used in portable audio and visual equipment, and further find wide application in electronic equipment, such as a charger for the portable audio and visual equipment.

INDUSTRIAL APPLICABILITY

In a loudspeaker and loudspeaker module of the present invention, the use of transparent film and a transparent panel can reduce the size of the loudspeaker and loudspeaker module and provide a display function, other than a function of emitting sound. Sound can be emitted from a display. Thus, the loudspeaker and loudspeaker module can be used for audio and visual equipment, telecommunications equipment, a game machine, and the like.

The invention claimed is:

1. A loudspeaker comprising:
- a magnetic circuit having a magnetic gap;
- a frame coupled to the magnetic circuit;
- a first diaphragm coupled to an outer periphery of the frame;
- a voice coil coupled to the first diaphragm and partially fitted in the magnetic gap of the magnetic circuit;
- a panel coupled to the frame;
- a space surrounded by the panel having the first diaphragm coupled thereto; and
- a second diaphragm coupled to the space surrounded by the panel;
- wherein the frame is embedded in a recess formed in the panel.

2. The loudspeaker of claim 1, wherein a step of the recess is at least 0.3 mm.

3. The loudspeaker of claim 1, wherein the recess is formed to conform to a shape of the outer periphery of the frame.

4. The loudspeaker of claim 1, wherein the recess is provided with at least three projections for guiding the frame.

5. The loudspeaker of claim 1, wherein adhesive or sealing agent is applied to the recess.

6. The loudspeaker of claim 1, wherein the first diaphragm is smaller than the second diaphragm.

7. The loudspeaker of claim 1, wherein the second diaphragm is made of sheet-like transparent film.

8. The loudspeaker of claim 1, wherein the panel is made of transparent material.

9. The loudspeaker of claim 1, wherein one of pressure sensitive adhesive and adhesive is applied to a connection face between the frame and the panel.

10. The loudspeaker of claim 1, wherein adhesive is applied to a gap in a connection face between the frame and the panel.

11. The loudspeaker of claim 1, wherein sealing agent is applied to a gap in a connection face between the frame and the panel.

12. A loudspeaker module comprising a loudspeaker, wherein the loudspeaker comprises:
- a magnetic circuit having a magnetic gap;
- a frame coupled to the magnetic circuit;
- a first diaphragm coupled to an outer periphery of the frame;
- a voice coil coupled to the first diaphragm and partially fitted in the magnetic gap of the magnetic circuit;
- a panel coupled to the frame;
- a space surrounded by the panel having the first diaphragm coupled thereto; and
- a second diaphragm coupled to the space surrounded by the panel;
- wherein the frame is embedded in a recess formed in the panel; and wherein the second diaphragm of the loudspeaker covers a front face of a display.

13. The loudspeaker module of claim 12, wherein one of pressure sensitive adhesive and adhesive is applied to a connection face between the frame and the panel.

14. The loudspeaker module of claim 12, wherein adhesive is applied to a gap in a connection face between the frame and the panel.

15. The loudspeaker module of claim 12, wherein sealing agent is applied to a gap in a connection face between the frame and the panel.

16. Electronic equipment comprising:
- a loudspeaker module, and
- an operation part,
- wherein the loudspeaker module comprises:
- a magnetic circuit having a magnetic gap;
- a frame coupled to the magnetic circuit;
- a first diaphragm coupled to an outer periphery of the frame;
- a voice coil coupled to the first diaphragm and partially fitted in the magnetic gap of the magnetic circuit;
- a panel coupled to the frame;
- a space surrounded by the panel having the first diaphragm coupled thereto; and
- a second diaphragm coupled to the space surrounded by the panel;
- wherein the frame is embedded in a recess formed in the panel; and
- wherein the second diaphragm of the loudspeaker module covers a front face of a display.

17. The electronic equipment of claim 16, wherein one of pressure sensitive adhesive and adhesive is applied to a connection face between the frame and the panel.

18. The electronic equipment of claim 16, wherein adhesive is applied to a gap in a connection face between the frame and the panel.

19. The electronic equipment of claim 16, wherein sealing agent is applied to a gap in a connection face between the frame and the panel.

20. A loudspeaker comprising:

a magnetic circuit having a magnetic gap;

a frame coupled to the magnetic circuit;

a first diaphragm coupled to an outer periphery of the frame;

a voice coil coupled to the first diaphragm and partially fitted in the magnetic gap of the magnetic circuit; and a panel coupled to the frame;

a space surrounded by the panel having the first diaphragm coupled thereto; and a second diaphragm coupled to the space surrounded by the panel;

wherein the frame includes an annular flange; and wherein the panel includes an annular fit rib having a diameter smaller than an inside diameter of the annular flange and larger than an outside diameter of an edge of the first diaphragm, said annular fit rib being fitted in the frame.

21. The loudspeaker of claim 20, wherein one of pressure sensitive adhesive and adhesive is applied to a connection face between the fit rib and the frame.

22. The loudspeaker of claim 20, wherein the first diaphragm is smaller than the second diaphragm.

23. The loudspeaker of claim 20, wherein the second diaphragm is made of sheet-like transparent film.

24. The loudspeaker of claim 20, wherein the panel is made of transparent material.

25. The loudspeaker of claim 20, wherein one of pressure sensitive adhesive and adhesive is applied to a connection face between the frame and the panel.

26. The loudspeaker of claim 20, wherein adhesive is applied to a gap in a connection face between the frame and the panel.

27. The loudspeaker of claim 20, wherein sealing agent is applied to a gap in a connection face between the frame and the panel.

28. A loudspeaker module comprising a loudspeaker, wherein the loudspeaker comprises:

a magnetic circuit having a magnetic gap;

a frame coupled to the magnetic circuit;

a first diaphragm coupled to an outer periphery of the frame;

a voice coil coupled to the first diaphragm and partially fitted in the magnetic gap of the magnetic circuit;

a panel coupled to the frame;

a space surrounded by the panel having the first diaphragm coupled thereto; and a second diaphragm coupled to the space surrounded by the panel;

wherein the frame includes an annular flange; and wherein the panel includes an annular fit rib having a diameter smaller than an inside diameter of the annular flange and larger than an outside diameter of an edge of the first diaphragm, said annular fit rib being fitted in the frame;

wherein the second diaphragm of the loudspeaker covers a front face of a display.

29. The loudspeaker module of claim 28, wherein one of pressure sensitive adhesive and adhesive is applied to a connection face between the fit rib and the frame.

30. Electronic equipment comprising:

a loudspeaker module, and an operation part, wherein the loudspeaker module comprises:

a magnetic circuit having a magnetic gap;

a frame coupled to the magnetic circuit;

a first diaphragm coupled to an outer periphery of the frame;

a voice coil coupled to the first diaphragm and partially fitted in the magnetic gap of the magnetic circuit; and a panel coupled to the frame;

a space surrounded by the panel having the first diaphragm coupled thereto; and a second diaphragm coupled to the space surrounded by the panel; and wherein the frame includes an annular flange; and wherein the panel includes an annular fit rib having a diameter smaller than an inside diameter of the annular flange and larger than an outside diameter of an edge of the first diaphragm, said annular fit rib being fitted in the frame;

wherein the second diaphragm of the loudspeaker module covers a front face of a display.

31. The electronic equipment of claim 30, wherein one of pressure sensitive adhesive and adhesive is applied to a connection face between the fit rib and the frame.

32. A loudspeaker comprising:

a magnetic circuit having a magnetic gap;

a frame coupled to the magnetic circuit;

a first diaphragm coupled to an outer periphery of the frame;

a voice coil coupled to the first diaphragm and partially fitted in the magnetic gap of the magnetic circuit;

a panel coupled to the frame;

a space surrounded by the panel having the first diaphragm coupled thereto; and a second diaphragm coupled to the space surrounded by the panel; and wherein the panel is coupled to the second diaphragm by a combination having at least pressure sensitive adhesive.

33. The loudspeaker of claim 32, wherein the combination further comprises a substrate.

34. The loudspeaker of claim 33, wherein the substrate of the combination is made of film material.

35. The loudspeaker of claim 34, wherein the film material is polyethylene terephthalate (PET).

36. The loudspeaker of claim 35, wherein the combination is a double-faced adhesive tape.

37. The loudspeaker of claim 33, wherein the first diaphragm is smaller than the second diaphragm.

38. The loudspeaker of claim 33, wherein the second diaphragm is made of transparent film.

39. The loudspeaker of claim 38, wherein the panel is made of transparent material.

40. The loudspeaker of claim 39, wherein the pressure sensitive adhesive is made of transparent material.

41. The loudspeaker of claim 40, wherein the substrate of the combination is made of transparent material.

42. The loudspeaker of claim 32, wherein the first diaphragm is smaller than the second diaphragm.

43. The loudspeaker of claim 32, wherein the second diaphragm is made of sheet-like transparent film.

44. The loudspeaker of claim 32, wherein the panel is made of transparent material.

45. The loudspeaker of claim 32, wherein sealing agent is applied to a gap in a connection face between the frame and the panel.

46. A loudspeaker module comprising a loudspeaker, wherein the loudspeaker comprises:

a magnetic circuit having a magnetic gap;

a frame coupled to the magnetic circuit;

a first diaphragm coupled to an outer periphery of the frame;

a voice coil coupled to the first diaphragm and partially fitted in the magnetic gap of the magnetic circuit;

a panel coupled to the frame;

a space surrounded by the panel having the first diaphragm coupled thereto; and a second diaphragm coupled to the space surrounded by the panel;

wherein the frame includes an annular flange;

wherein the panel includes an annular fit rib having a diameter smaller than an inside diameter of the annular flange and larger than an outside diameter of an edge of the first diaphragm, said annular fit rib being fitted in the frame; and wherein the panel is coupled to the second diaphragm by a combination having at least pressure sensitive adhesive; and wherein the second diaphragm of the loudspeaker module covers a front face of a display.

47. The loudspeaker module of claim 46, wherein the combination further comprises a substrate.

48. Electronic equipment comprising:

a loudspeaker module, and an operation part, wherein the loudspeaker module comprises:

a magnetic circuit having a magnetic gap;

a frame coupled to the magnetic circuit;

a first diaphragm coupled to an outer periphery of the frame;

a voice coil coupled to the first diaphragm and partially fitted in the magnetic gap of the magnetic circuit; and a panel coupled to the frame;

a space surrounded by the panel having the first diaphragm coupled thereto; and a second diaphragm coupled to the space surrounded by the panel;

wherein the panel is coupled to the second diaphragm by a combination having at least pressure sensitive adhesive; and wherein the second diaphragm of the loudspeaker module covers a front face of a display.

49. The electronic equipment of claim 48, wherein the combination further comprises a substrate.

* * * * *